US006050549A

United States Patent [19]

Foy

[11] Patent Number: 6,050,549

[45] Date of Patent: Apr. 18, 2000

[54] FENCE CLIP SYSTEM

[76] Inventor: Bill D. Foy, P. O. Box 839, Platteville, Colo. 80651

[21] Appl. No.: 09/018,102

[22] Filed: Feb. 3, 1998

[51] Int. Cl.[7] ..... E04H 17/02

[52] U.S. Cl. ..... 256/57; 256/48; 256/32; 256/54

[58] Field of Search ..... 256/32, 47, 48, 256/49, 54, 57, DIG. 3

[56] References Cited

U.S. PATENT DOCUMENTS

| | | | |
|---|---|---|---|
| 373,596 | 11/1887 | McGrew | 256/57 X |
| 545,107 | 8/1895 | Spoore | 256/21 X |
| 550,669 | 12/1895 | Wright | 256/54 X |
| 637,634 | 11/1899 | Martz | 256/57 |
| 874,453 | 12/1907 | Stout | 256/57 |
| 969,231 | 9/1910 | Wilkison | 256/54 |
| 1,102,394 | 7/1914 | De Ros | 256/54 |
| 1,454,254 | 5/1923 | Roney | 256/57 |
| 1,807,898 | 6/1931 | Davidson | 256/57 |
| 1,814,228 | 7/1931 | Peters | 256/57 |
| 1,848,515 | 3/1932 | Davidson | 256/57 |
| 2,053,195 | 9/1936 | Jernegan | 256/57 |
| 4,243,343 | 1/1981 | Wier | 403/397 X |
| 4,982,932 | 1/1991 | Baker | 256/47 |
| 5,275,383 | 1/1994 | Wick et al. | 256/57 |
| 5,577,712 | 11/1996 | White, Jr. | 256/7 X |
| 5,593,142 | 1/1997 | Gerhart | 256/54 |
| 5,788,223 | 8/1998 | Stockton | 256/45 X |

FOREIGN PATENT DOCUMENTS

| | | | |
|---|---|---|---|
| 15302 | 11/1911 | Denmark | 256/57 |
| 4837 | 9/1911 | United Kingdom | 256/57 |
| 11520 | 9/1915 | United Kingdom | 256/57 |

*Primary Examiner*—Peter M. Cuomo
*Assistant Examiner*—Brian H. Buck
*Attorney, Agent, or Firm*—Dean P. Edmundson

[57] ABSTRACT

A fence clip assembly is described for securing barbed wire strands and the like to support posts comprising legs or tabs to attach it to the post and an arched center section to allow installation onto an existing wire strand and to allow freedom of lateral movement of the strand relative to the support post while the clip is fastened to the post.

2 Claims, 2 Drawing Sheets

FENCE CLIP SYSTEM

FIELD OF THE INVENTION

This invention relates to fence and wire connectors and is particularly concerned with the connectors used to attached barbed wire strands to T-post type metal support posts.

BACKGROUND OF THE INVENTION

For many years, livestock and boundary fences incorporating barbed wire strands attached to metal support posts have been used. The metal support posts most frequently used are of a generally T-shaped cross-sectional configuration and with spaced alignment guides to maintain the spacing of plural strands of wire making up a fence. The wire strands are secured to a metal post with a short length of wire that has one end wrapped around a strand, then passed around the post, and then the other end is wrapped around the strand to hold the strand to the post. This method binds the wire quite securely to the post with regard to both fore and aft and lateral movement of the wire strand.

To provide a tightly stretched fence, using the conventional wire post ties, metal T-posts, and barbed wire, it has been necessary to employ a wire puller to stretch each length of wire between adjacent posts or to remove the wire ties prior to stretching the strands. This is a time-consuming and cumbersome task. Snow loads acting on a fence co constructed usually result in broken wire strands because the strands are held rigidly to the post, and lateral movement of the wire strands relative to the posts is essentially prevented.

SUMMARY OF THE PRESENT INVENTION

Principal objects of this invention are to provide a fence clip assembly that may be used with conventional metal fence posts and barbed wire strands and that will securely support said strands and will allow stretching or tightening of the strands from a single point along the span of the fence without necessitating the removal of the clip assemblies from the support posts.

Another object of the present invention is to provide a fence clip assembly that will allow the tension of stretching and the tension caused by snow loads and by impacts to be spread evenly over the entire span of the fence and to thus reduce the incidence of broken strands.

Still another object of the invention is to provide a utilitarian fence clip assembly which can be produced and marketed economically and will therefore become readily available to those desiring to employ it.

Principal features of the invention include a main body having a loop through which a barbed wire strand may freely pass and having an upper and a lower pair of legs or tabs to provide for attachment to the post and with an open span between the upper and lower pairs of legs or tabs to allow the clip to be installed on or removed from an existing barbed wire strand. Additional objects and features of the invention will become apparent to those skilled in the science and art to which the invention pertains from the following detailed description and claims.

BRIEF DESCRIPTION OF THE DRAWINGS

The invention is described in more detail hereinafter with reference to the accompanying drawings, wherein like reference characters refer to the same parts throughout the several views and in which.

DETAILED DESCRIPTION OF THE INVENTION

Figure 1:
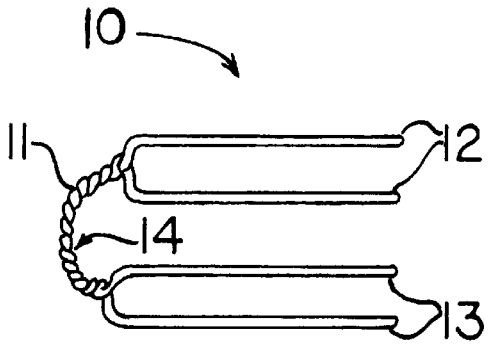
FIG. 1 is a perspective view of a preferred embodiment of a fence clip of this invention.

In the preferred embodiment of FIG. 1, the clip is shown generally at 10 and includes two pieces of a strong, durable material (such as galvanized steel wire) which are joined for a length at their center 11 and include an upper and lower pair of legs 12 and 13, respectively, of sufficient length to straddle a metal T-post and to be fastened together on the side of the post opposite the wire strand. The center section 11 is formed to provide a semi-circular loop 14 of sufficient dimension through which a barbed wire strand may pass relatively unobstructed. As an example, this dimension may be approximately one inch in height inside and approximately three-fourths of an inch away from the post at its greatest distance. The overall height of the clip must not exceed the distance between the alignment guides of a standard metal T-post, this distance being approximately one and one-half inches. The legs 12 and 13 are bent away from the center section 11 at approximate ninety degree angles and are bent again at approximately ninety degrees to form the shape illustrated in FIG. 1. The upper legs must provide a sufficient span to straddle the width of a metal T-post as must the lower legs, this distance being roughly one and one-half inches.

Figure 2:
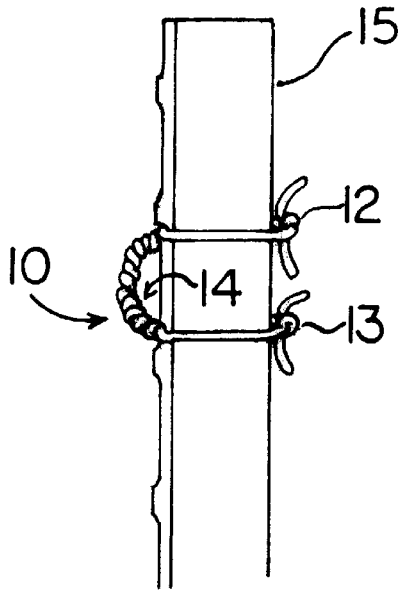
FIG. 2 illustrates the fence clip of FIG. 1 fastened to a conventional T-post.

FIG. 2 illustrates the fence clip assembly 10 installed on a metal T-post 15 with the upper legs 12 fastened together and the lower legs 13 fastened together on the backside of the support post (e.g., by twisting the legs of each pair together). Also illustrated in FIG. 2 is the loop 14 to capture the wire strand.

Figure 3:
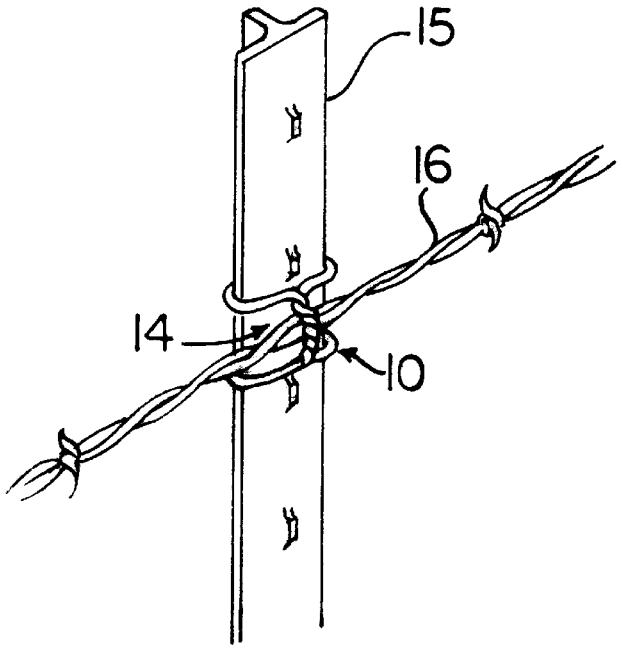
FIG. 3 is a perspective view of the fence clip of FIG. 1 secured to a T-post and retaining a wire strand to the post.

FIG. 3 shows the fence clip assembly 10 installed on a metal T-post 15 and illustrates how the clip retains the wire strand 16 to the post but allows the strand to move laterally through the loop 14 with little restriction.

Figure 4:
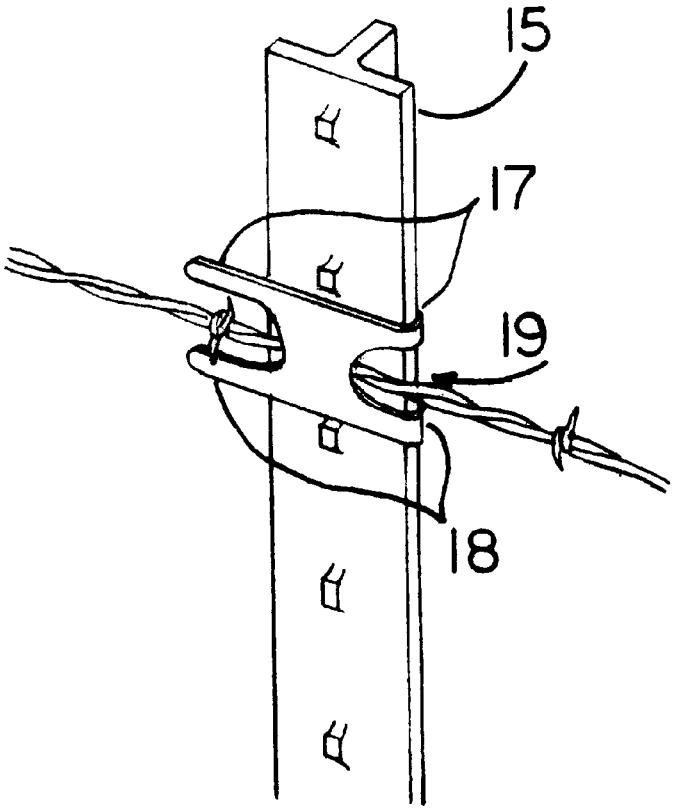
FIG. 4 is a perspective view illustrating another embodiment of a fence clip retaining a wire strand to a post.

FIG. 4 is an illustration of a second embodiment of the fence clip being manufactured of a strong and durable material such as stamped mild steel. In this embodiment, there are an upper and lower pair of tabs 17 and 18, respectively, provided for attachment to the T-post. The tabs on one side (one upper and one lower) are pre-shaped to fit snugly around the edge of a T-post 15 while the other two tabs are left straight and are bent around the other side edge of the post by the installer after positioning the clip over the wire strand at the desired height on the post. Like the preferred embodiment, this clip also utilizes a loop at its center 19 to allow the barbed wire strand to pass through without restriction.

Figure 5:
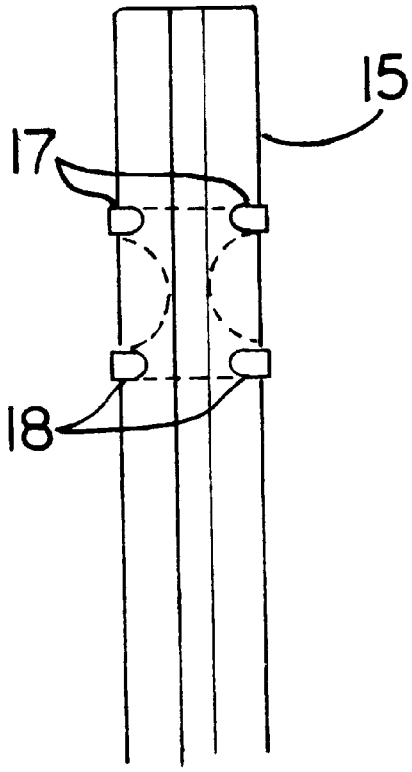
FIG. 5 is a rear elevational view of the fence clip of FIG. 4 fastened to a post.

FIG. 5 shows the second embodiment of fence clip installed on a T-post 15 with all the tabs crimped to secure the clip to the post.

Although a preferred embodiment of my invention has been herein disclosed, it is to be understood that the present disclosure is by way of example and that variations are possible without departing from the subject matter coming within the scope of the following claim, which subject matter I claim as my invention.

What is claimed is:

1. In barbed wire and T-post fence construction, the process of allowing a wire strand to remain free of support posts with regard to the strand's lateral movement, comprising the steps of:

(a) providing a fence clip comprising a main body consisting of a wire loop of sufficient size to allow said barbed wire to pass freely between said loop and said post; wherein said clip includes an upper and a lower pair of legs for extending around said post;

(b) positioning the clip over the wire strand such that the strand is captured between the loop and the post; and (c) connecting the legs of the fence clip to the post.

2. A process in accordance with claim 1, wherein the legs of said upper pair are connected together on the side of said post opposite the wire strand, and wherein the legs of said lower pair are connected together on the side of said post opposite the wire strand.

* * * * *